US011684086B2

(12) United States Patent
Lei et al.

(10) Patent No.: US 11,684,086 B2
(45) Date of Patent: Jun. 27, 2023

(54) MODULAR MULTIFUNCTIONAL ELECTRONIC SMOKING PARAPHERNALIA

(71) Applicant: CHINA TOBACCO YUNNAN INDUSTRIAL CO., LTD, Kunming (CN)

(72) Inventors: Ping Lei, Kunming (CN); Xudong Zheng, Kunming (CN); Jianguo Tang, Kunming (CN); Zhiqiang Li, Kunming (CN); Shanzhai Shang, Kunming (CN); Jingmei Han, Kunming (CN); Chengya Wang, Kunming (CN); Ru Wang, Kunming (CN); Xu Zeng, Kunming (CN); Dalin Yuan, Kunming (CN); Jie Tang, Kunming (CN); Yang Su, Kunming (CN); Dong Xiao, Kunming (CN); Yongkuan Chen, Kunming (CN)

(73) Assignee: CHINA TOBACCO YUNNAN INDUSTRIAL CO., LTD, Kunming (CN)

( * ) Notice: Subject to any disclaimer, the term of this patent is extended or adjusted under 35 U.S.C. 154(b) by 1038 days.

(21) Appl. No.: 16/449,488

(22) Filed: Jun. 24, 2019

(65) Prior Publication Data

US 2019/0328043 A1 Oct. 31, 2019

(30) Foreign Application Priority Data

Apr. 26, 2018 (CN) ..... 201810386113.8

(51) Int. Cl.
*A24F 47/00* (2020.01)
*A24F 40/50* (2020.01)
(Continued)

(52) U.S. Cl.
CPC ..... *A24F 40/50* (2020.01); *A24F 40/485* (2020.01); *A24F 40/20* (2020.01)

(58) Field of Classification Search
CPC ..... A24F 40/20; A24F 40/30; A24F 40/40
See application file for complete search history.

(56) References Cited

U.S. PATENT DOCUMENTS

2017/0181470 A1* 6/2017 Li ..... A24F 40/485
2017/0333651 A1* 11/2017 Qiu ..... A24F 40/40
(Continued)

FOREIGN PATENT DOCUMENTS

CN 102387719 B 3/2016
CN 106307622 B 10/2018

*Primary Examiner* — Eric Yaary
(74) *Attorney, Agent, or Firm* — Bayramoglu Law Offices LLC

(57) ABSTRACT

A modular multifunctional electronic smoking paraphernalia includes a main body module provided with a slide rod a and a slide rod b, a cigarette holder module provided with a slide groove a, and an atomization module provided with a slide groove b. The cigarette holder module is detachably and slidably connected to the main body module by the slide rod a and the slide groove a. The atomization module is detachably and slidably connected to the main body module by the slide rod b and the slide groove b. In the present invention, the smoking paraphernalia is designed as three detachable modules, namely, the main body module, the cigarette holder module and the atomization module, which is convenient for the smoker to operate.

9 Claims, 3 Drawing Sheets

(51) Int. Cl.
*A24F 40/485* (2020.01)
*A24F 40/20* (2020.01)

(56) References Cited

U.S. PATENT DOCUMENTS

| | | | | |
|---|---|---|---|---|
| 2018/0042299 | A1* | 2/2018 | Han | A24F 40/30 |
| 2018/0289069 | A1* | 10/2018 | Reevell | A24F 40/50 |
| 2018/0368474 | A1* | 12/2018 | Bache | H01R 13/2421 |
| 2020/0288782 | A1* | 9/2020 | Qiu | A24F 40/60 |

* cited by examiner

MODULAR MULTIFUNCTIONAL ELECTRONIC SMOKING PARAPHERNALIA

CROSS REFERENCE TO THE RELATED APPLICATIONS

This application is based upon and claims priority to Chinese Patent Application No. CN201810386113.8, filed on Apr. 26, 2018, the entire contents of which are incorporated herein by reference.

TECHNICAL FIELD

The present invention belongs to the technical field of electronic cigarette smoking paraphernalia, and in particular relates to a modular multifunctional electronic smoking paraphernalia.

BACKGROUND

With an increase in health awareness, smokers are gradually noticing that traditional cigarettes are detrimental to their health, which facilitates the development of smoking cessation or alternative tobacco products like the electronic cigarette, the low-temperature baking-type smoking paraphernalia, etc. For the electronic cigarette, the medium capable of generating the smoke such as the e-juice, the paste, etc. is heated by using the heating component to generate smoke, so as to satisfy the visual experience as though the smoker is smoking the traditional cigarette. The excitant substances like nicotine, etc. can be added in the medium, but the taste of the electronic cigarette is greatly different from that of the traditional cigarette, thus causing the actual effect of the electronic cigarette to be unsatisfactory. For the low-temperature baking-type smoking paraphernalia, the specially-made cigarette is heated by using the heating component to release the nicotine and other substances contained in the cigarette, so as to satisfy the smoker. Due to the relatively low heating temperature, the smoke generated by the cigarette is less than that of a traditional cigarette, and the smoker's visual experience is not well satisfied. Therefore, the low-temperature baking-type smoking paraphernalia are also not popular among smokers.

At present, the development of the electronic atomization technique has been already mature. The Chinese Patent Application No. 201080016105.6 disclosed an electronic atomization device, including a power supply device, a sensor, an atomization core assembly, a liquid storage component, and a containing housing. Specifically, the containing housing is provided with an auxiliary air inlet; the atomization core assembly includes an electrically heating member and a liquid permeating member; after the sensor receives the signal, the atomization core assembly starts to work accordingly, namely atomizing the e-juice capable of generating the smoke. Nonetheless, the taste of the smoke generated by the electronic atomization device is other than that of the traditional cigarette. The low-temperature baking technique is also well-known. For example, the Chinese Patent Application No. 201611005132.9 disclosed a non-burning smoking paraphernalia during heating, including a base, an electrode, an insulation sleeve, an insulation holder, a tubular heating component, an upper cover, a sleeve, etc. The non-burning smoking paraphernalia can heat the tobacco section in the circumferential direction, but there is the same problem where the volume of smoke is less when heating the non-burning products.

The electronic atomization devices available on the market are mostly controlled to start by using the air flow sensor or the air pressure sensor. For example, the Chinese Patent Application No. 201080016105.6 disclosed an electronic atomization device, including a power supply device, a sensor, an atomization core assembly, a liquid storage component, and a containing housing. Specifically, the containing housing is provided with an auxiliary air inlet; the atomization core assembly includes an electrically heating member and a liquid permeating member; the electrically heating member is provided with a through hole; the liquid storage component is provided with a channel; the sensor is interconnected to the through hole and the channel, and forms an air flow circulation with the auxiliary air inlet. However, the airflow channel of the sensor in the device is coincident with the airflow channel of the smoke, so that the air flow in the two airflow channels is distributed unevenly, which causes the unstable smoking function. Moreover, when the airflow channel of the sensor is coincident with the airflow channel of the smoke, the condensation liquid generated by the atomizer during use may affect the sensor or even cause the sensor to malfunction.

Currently, there is no product which can well combine the electronic atomization technique with low-temperature baking technique available on the market. Besides, some of the electronic atomization devices available on the market need a repeat e-juice injection, which is inconvenient to operate, and not clean and sanitary.

SUMMARY

The objective of the present invention is to provide a smoking paraphernalia with double airflow channels, which effectively solves the problems such as the terrible smoking experience of the electronic cigarette and the low-temperature baking cigarette, the unstable smoking due to the coincidence of the sensor airflow path and the smoke airflow channel, and the damage to the sensor caused by the condensation liquid produced by the atomizer.

The objective of the present invention is achieved by the following technical solutions.

A modular multifunctional electronic smoking paraphernalia includes:

a main body module, wherein the main body module is provided with a slide rod a and a slide rod b;

a cigarette holder module, wherein the cigarette holder module is provided with a slide groove a; and an atomization module, wherein the atomization module is provided with a slide groove b; wherein the cigarette holder module and the main body module are detachably and slidably connected through the slide rod a and the slide groove a; and the atomization module and the main body module are detachably and slidably connected through the slide rod b and the slide groove b.

In a preferred embodiment of the present invention, the main body module includes a slide lid assembly, a sensor assembly, and a heating assembly, wherein the slide lid assembly includes a slide lid switch, a first elastic piece, a second elastic piece, an elastic piece fixer, a first limit block and a first control board; the slide lid switch and the elastic piece fixer are fixed on the first limit block by a first screw; the first control board is fixed on the first limit block by a fourth screw; the second elastic piece is fixed on the first control board; and the first elastic piece is fixed on the elastic piece fixer.

In a preferred embodiment of the present invention, the sensor assembly includes a sensor and a sensor holder, wherein the sensor is fixed on the sensor holder, and the sensor holder is provided with an air channel.

In a preferred embodiment of the present invention, the heating assembly includes a heating body and a heating body holder, wherein the heating body is fixed on the heating body holder, and the heating body is provided with an air hole.

In a preferred embodiment of the present invention, the cigarette holder module includes a cigarette holder housing and a cigarette holder, wherein the cigarette holder is surrounded by a protection cover; the protection cover is hermetically connected to the cigarette holder housing by a first O-shaped ring; the protection cover is hermetically fixed on a protection cover holder by a second O-shaped ring; the protection cover holder is hermetically and fixedly connected to the heating body holder by a third O-shaped ring.

In a preferred embodiment of the present invention, the atomization module includes a heating wire, a heating wire holder, an atomizer support, an atomizer base, and an atomizer housing, wherein the heating wire is fixed on the heating wire holder; the heating wire holder is fixed on the atomizer base; the heating wire holder is covered by the atomizer support; and the atomizer housing is connected to the atomizer support by a second sealing gasket and a third sealing gasket in an inlaid manner.

In a preferred embodiment of the present invention, the atomization module further includes an atomizer connection sleeve, wherein the atomizer connection sleeve is hermetically connected to the atomizer housing by a fourth O-shaped ring; an interior of the atomizer connection sleeve is wrapped with a connection tube; and the connection tube is hermetically connected to the atomizer housing by a first sealing gasket.

In a preferred embodiment of the present invention, the atomizer housing is connected to and fixed on the atomizer base in an inlaid manner, and the atomizer base is wrapped by an atomizer cover.

In a preferred embodiment of the present invention, the main body module further includes an inner support, and a second control board, wherein the second control board is provided with an air hole; the second control board is fixed on the inner support by a second screw and a third screw; and the heating assembly is detachably fixed on the inner support.

In a preferred embodiment of the present invention, the main body module further includes a battery, a USB charging port and a switch, wherein a gap is provided between the battery and the second control board; a sensor airflow path is defined by the USB charging port, the air hole, the gap and the air channel; a smog airflow channel is provided in the atomization module; a cavity of the cigarette holder is connected to the smog airflow channel by the air hole; a smoke airflow channel is defined by the cavity, the smog airflow channel and the air hole; the sensor airflow path is configured to be parallel to the smog airflow channel, and is interconnected to the smoke airflow channel by the air hole; an interconnection point is located on the upper portion of the cigarette holder and the lower portion of the smog airflow channel; and the sensor is located within the sensor airflow path.

The key points of the present invention are as follows. 1. The smoking paraphernalia is designed as three detachable modules, i.e., the main body module, the cigarette holder module and the atomization module, which is convenient for the smoker to operate. Moreover, the atomization module of the present invention is single-use without the need to repeatedly refill the e-juice, which is user-friendly and sanitary. 2. The sensor airflow path and the cigarette airflow channel are designed as two airflow channels that are independent of each other. On one hand, the damage to the sensor caused by the condensation liquid produced by the smoke airflow channel can be effectively avoided on the other hand, the present invention combines the electronic cigarette e-juice with the low-temperature baking cigarette, which not only increases the amount of smoke, but also effectively improves the taste of smoking the electronic cigarette.

The working process of the present invention is as follows:

The slide lid switch is opened; the cigarette holder module is taken out; the cigarette is inserted into the cigarette holder; the cigarette holder module is then inserted into the smoking paraphernalia; and the switch is pressed down. After that, the smoking paraphernalia starts to work; the heating body heats the cigarette inserted therein; and the heating component in the atomization module enters a preheating state. After completing the heating process, the smoker can smoke through the cigarette butt. During the smoking process, the air in the sensor airflow path is sucked, thereby generating negative pressure to the sensor, and triggering the atomizer in the atomization module. Namely, the atomizer atomizes the e-juice. The air enters the smoking paraphernalia from the opening at the bottom of the atomizer, and reaches the heating component inside the atomizer. The e-juice, heated and atomized by the heating component, is carried into the cigarette holder, and is mixed with the smoke generated after the heating component heats the cigarette. Finally, the mixed smoke is sucked by the smoker.

The advantages of the present invention is as follows.

1. The smoking paraphernalia is designed as three detachable modules, i.e., the main body module, the cigarette holder module and the atomization module, which is convenient for the smoker to operate. Moreover, the atomization module of the present invention is single-use without the need to repeatedly refill e-juice, which is user-friendly and sanitary.

2. In the present invention, the heating component and the atomizer are simultaneously provided in the smoking paraphernalia, which can realize the combination of the low-temperature baking cigarette and the electronic cigarette e-juice, and effectively overcomes the drawback of the smoke generated by the atomizer, such as the bad smoking experience and the insufficient odor.

3. In the present invention, two independent channels, i.e., the sensor airflow path and the smoke airflow channel, are provided in parallel in the smoking paraphernalia, which effectively improves the situation of the uneven airflow distribution and the unstable smoking function due to the coincidence of the sensor airflow path and the smoke airflow channel. Meanwhile, the sensor is prevented from the damage caused by the condensation liquid which is generated in the smoking process due to the coincidence of the sensor airflow path and the smoke airflow channel.

4. The smoking paraphernalia of the present invention has a simple structure, and is operated easily.

Figure 1:
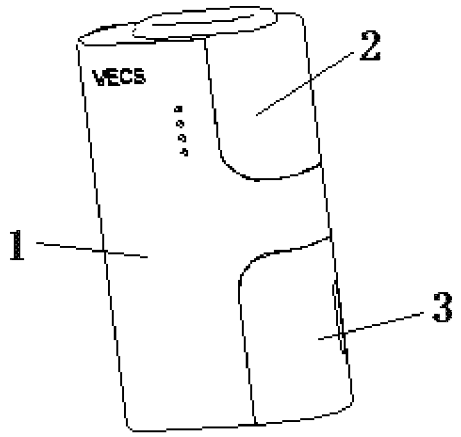
FIG. 1 is a schematic diagram showing an overall structure of a device of the present invention.
Figure 2:
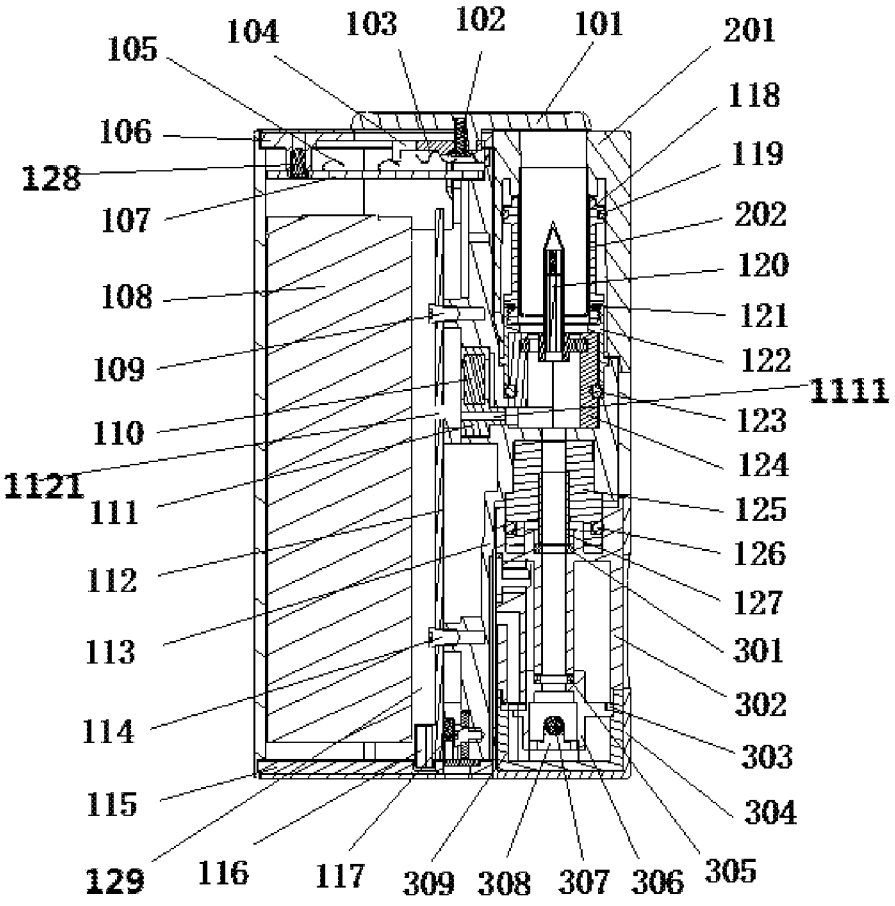
FIG. 2 is a cross-sectional view showing an internal structure of a device of the present invention.
Figure 3:
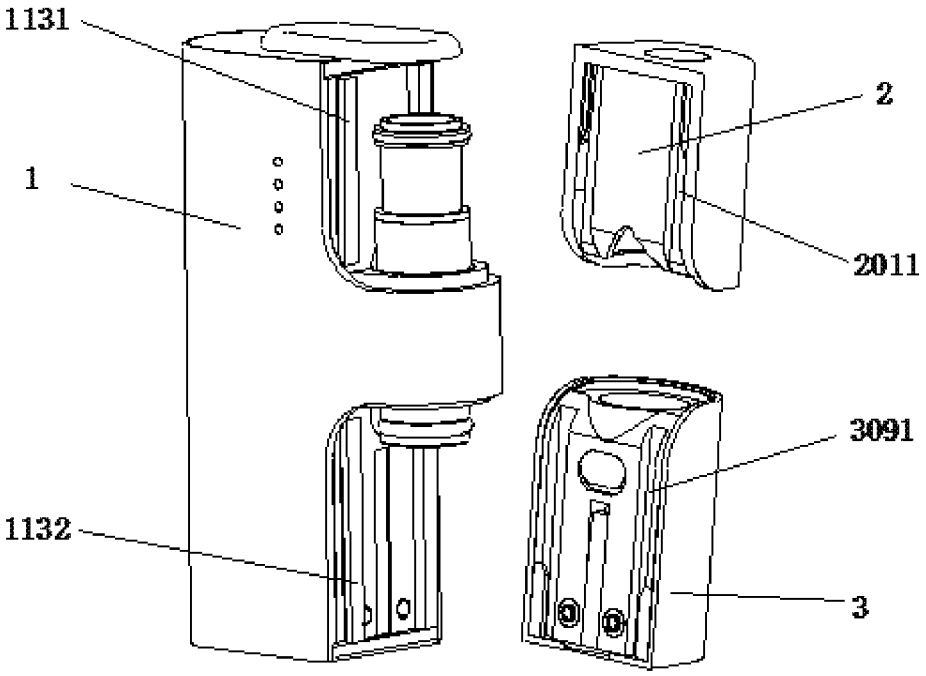
FIG. 3 is an exploded view of the paraphernalia device of the present invention.
Figure 4:
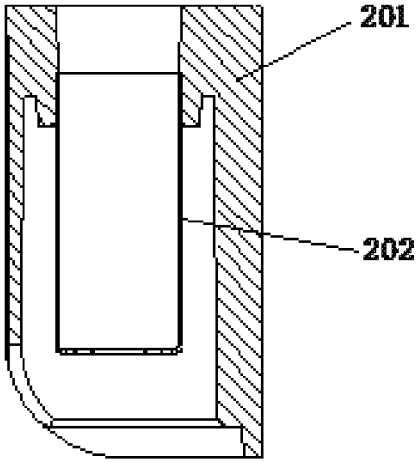
FIG. 4 is a cross-sectional view of a cigarette holder module of a device of the present invention.
Figure 5:
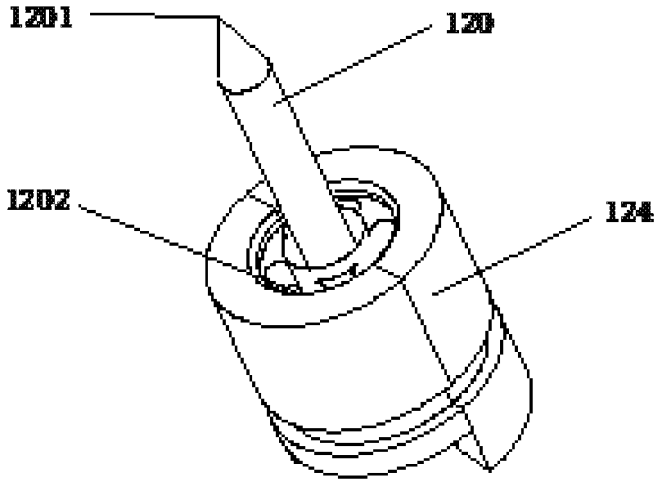
FIG. 5 is a perspective view of a heating assembly of a device of the present invention.

In the drawings: 1: main body module; 2: cigarette holder module; 3: atomization module; 100: smoking paraphernalia; 101: slide lid switch; 102: first screw; 103: first elastic piece; 104: elastic piece fixer; 105: second elastic piece; 106: first limit block; 107: first control board; 108: battery; 109: second screw; 110: sensor; 111: sensor holder, 1111: air channel; 112: second control board, 1121: air hole; 113: inner support; 114: third screw; 115: second limit block; 116: USB charging port; 117: switch; 118: protection cover; 119: first O-shaped ring; 120: heating body; 121: second O-shaped ring; 122: protection cover holder; 123: third O-shaped ring; 124: heating body holder; 125: atomizer connection sleeve; 126: fourth O-shaped ring; 127: connection tube, 128: fourth screw, 129: gap; 201: cigarette holder housing; 202: cigarette holder; 301: first sealing gasket; 302: atomizer housing; 303: second sealing gasket; 304: atomizer cover; 305: third sealing gasket; 306: atomizer support; 307: heating wire; 308: heating wire holder; 309: atomizer base; 1131: slide rod a; 1132: slide rod b; 1201: heating body head; 1202: air hole; 2011: slide groove a; 3091: slide groove b.

DETAILED DESCRIPTION OF THE EMBODIMENTS

The following embodiments are intended to illustrate the present invention, and not to further limit the scope of protection of the present invention.

Embodiment

A modular multifunctional electronic smoking paraphernalia includes:

the main body module 1, wherein the main body module 1 is provided with the slide rod a 1131 and the slide rod b 1132;

the cigarette holder module 2, wherein the cigarette holder module 2 is provided with the slide groove a 2011; and the atomization module 3, wherein the atomization module 3 is provided with the slide groove b 3091.

The cigarette holder module 2 and the main body module 1 are detachably and slidably connected through the slide rod a 1131 and the slide groove a 2011.

The atomization module 3 and the main body module 1 are detachably and slidably connected through the slide rod b 1132 and the slide groove b 3091.

In a preferred embodiment of the present invention, the main body module 1 includes the slide lid assembly, the sensor assembly, and the heating assembly. The slide lid assembly includes the slide lid switch 101, the first elastic piece 103, the second elastic piece 105, the elastic piece fixer 104, the first limit block 106 and the first control board 107. The slide lid switch 101 and the elastic piece fixer 104 are fixed on the first limit block 106 by the first screw 102. The first control board 107 is fixed on the first limit block 106 by the fourth screw 128. The second elastic piece 105 is fixed on the first control board 107. The first elastic piece 103 is fixed on the elastic piece fixer 104.

In a preferred embodiment of the present invention, the sensor assembly includes the sensor 110 and the sensor holder 111. The sensor 110 is fixed on the sensor holder 111, and the sensor holder 111 is provided with the air channel 1111.

In a preferred embodiment of the present invention, the heating assembly includes the heating body 120 and the heating body holder 124. The heating body 120 is fixed on the heating body holder 124, and the heating body 120 is provided with the air hole 1202.

In a preferred embodiment of the present invention, the cigarette holder module 2 includes the cigarette holder housing 201 and the cigarette holder 202. The cigarette holder 202 is surrounded by the protection cover 118. The protection cover 118 is hermetically connected to the cigarette holder housing 201 by the first O-shaped ring 119. The protection cover 118 is hermetically fixed on the protection cover holder 122 by the second O-shaped ring 121. The protection cover holder 122 is hermetically and fixedly connected to the heating body holder 124 by the third O-shaped ring 123.

In a preferred embodiment of the present invention, the atomization module 3 includes the heating wire 307, the heating wire holder 308, the atomizer support 306, the atomizer base 309, and the atomizer housing 302. The heating wire 307 is fixed on the heating wire holder 308. The heating wire holder 308 is fixed on the atomizer base 309. The heating wire holder 308 is covered by the atomizer support 306. The atomizer housing 302 is hermetically connected to the atomizer support 306 by the second sealing gasket 303 and the third sealing gasket 305 in an inlaid manner.

In a preferred embodiment of the present invention, the atomization module 3 further includes the atomizer connection sleeve 125. The atomizer connection sleeve 125 is hermetically connected to the atomizer housing 302 by the fourth O-shaped ring 126 in an inlaid manner. The interior of the atomizer connection sleeve 125 is wrapped with the connection tube 127. The connection tube 127 is hermetically connected to the atomizer housing 302 by the first sealing gasket 301.

In a preferred embodiment of the present invention, the atomizer housing 302 is connected to and fixed on the atomizer base 309 in an inlaid manner, and the atomizer base 309 is wrapped by the atomizer cover 304.

In a preferred embodiment of the present invention, the main body module 1 further includes the inner support 113, and the second control board 112. The second control board 112 is provided with the air hole 1121. The second control board 112 is fixed on the inner support 113 by the second screw 109 and the third screw 114. The heating assembly is detachably fixed on the inner support 113.

In a preferred embodiment of the present invention, the main body module 1 further includes the battery 108, the USB charging port (116) and the switch 117. The gap 129 is provided between the battery 108 and the second control board 112. The sensor airflow path is defined by the USB charging port 116, the air hole 1121, the gap 129 and the air channel 1111. The smog airflow channel is provided in the atomization module 3. The cavity of the cigarette holder 202 is interconnected to the smog airflow channel by the air hole (1202). The smoke airflow channel is defined by the cavity, the smog airflow channel and the air hole. The sensor airflow path is configured to be parallel to the smog airflow channel, and is interconnected to the smoke airflow channel by the air hole 1121. The interconnection point is located on the upper portion of the cigarette holder 202 and the lower portion of the smog airflow channel. The sensor 110 is located within the sensor airflow path.

The working process of the present invention is as follows:

The slide lid switch 101 is opened. The smoker takes out the cigarette holder module. The cigarette is inserted into the cigarette holder 202. Then the cigarette holder module is inserted into the smoking paraphernalia, and the switch 117 is pressed down to make the smoking paraphernalia enter a working state. The heating body 120 heats the cigarette inserted therein. The heating component in the atomization module 3 enters a preheating state. After completing the heating process, the smoker can smoke through the cigarette butt. During the smoking process, the air in the sensor airflow path is sucked, thereby generating negative pressure to the sensor 110, and triggering the atomizer in the atomization module 3. Namely, the atomizer atomizes the e-juice. The air enters the smoking paraphernalia from the opening at the bottom of the atomizer, and reaches the heating component inside the atomizer. The e-juice, which is heated and atomized by the heating component, is carried into the cigarette holder 202, and is mixed with the smoke generated after the heating component 120 heats the cigarette. Finally, the mixed smoke is sucked by the smoker.

Definitions: The word "slidably" means component A connects to component B by sliding components together. "Detachably" means component A is connected to component B yet it is possible to detach component A from component B.

The invention claimed is:

1. A modularmultifunctional electronic smoking paraphernalia, comprising: a main body module, wherein the main body module is provided with a first slide rod and a second slide rod; a cigarette holder module, wherein the cigarette holder module is provided with a first slide groove; and an atomization module, wherein the atomization module is provided with a second slide groove; wherein the cigarette holder module and the main body module are detachably and slidably connected through the first slide rod and the first slide groove; and the atomization module and the main body module are detachably and slidably connected through the second slide rod and the second slide groove;

wherein the main body module comprises a slide lid assembly, a sensorasse mbly, and a heating assembly; the slide lid assembly comprises a slide lid switch, a first elastic piece, a second elastic piece, an elastic piece fixer, a first limit block and a first control board; the slide lid switch is fixed with the elastic piece fixer by a first screw; the first control board is fixed on the first limit block by a fourth screw; the second elastic piece is fixed on the first control board; and the first elastic piece is fixed on the elastic piece fixer.

2. The modular multifunctional electronic smoking paraphernalia according to claim 1, wherein the sensor assembly comprises a sensor and a sensor holder, the sensor is fixed on the sensor holder, and the sensor holder is provided with an air channel.

3. The modular multifunctional electronic smoking paraphernalia according to claim 1, wherein the heating assembly comprises a heating body and a heating body holder, the heating body is fixed on the heating body holder, and the heating body is provided with a first air hole.

4. The modular multifunctional electronic smoking paraphernalia according to claim 3, wherein the cigarette holder module comprises a cigarette holder housing and a cigarette holder, the cigarette holder is surrounded by a protection cover; the protection cover is hermetically connected to the cigarette holder housing by a first O-shaped ring; the protection cover is hermetically fixed on a protection cover holder by a second O-shaped ring; the protection cover holder is hermetically and fixedly connected to the heating body holder by a third O-shaped ring.

5. The modular multifunctional electronic smoking paraphernalia according to claim 1, wherein the atomization module comprises a heating wire, a heating wire holder, an atomizer support, an atomizer base, and an atomizer housing, the heating wire is fixed on the heating wire holder; the heating wire holder is fixed on the atomizer base; the heating wire holder is covered by the atomizer support; and the atomizer housing is hermetically connected to the atomizer support by a second sealing gasket and a third sealing gasket in an inlaid manner.

6. The modular multifunctional electronic smoking paraphernalia according to claim 5, wherein the atomization module further comprises an atomizer connection sleeve, wherein the atomizer connection sleeve is hermetically connected to the atomizer housing by a fourth O-shaped ring in an inlaid manner; an interior of the atomizer connection sleeve is wrapped with a connection tube; and the connection tube is hermetically connected to the atomizer housing by a first sealing gasket.

7. The modular multifunctional electronic smoking paraphernalia according to claim 5, wherein the atomizer housing is connected to and fixed on the atomizer base in an inlaid manner, and the atomizer base is wrapped by an atomizer cover.

8. The modular multifunctional electronic smoking paraphernalia according to claim 1, wherein the main body module further comprises an inner support and a second control board, the second control board is provided with a second air hole; the second control board is fixed on the inner support by a second screw and a third screw; and the heating assembly is detachably fixed on the inner support.

9. The modular multifunctional electronic smoking paraphernalia according to claim 8, wherein the main body module further comprises a battery, a USB charging port and a switch, a gap is provided between the battery and the second control board; a sensor airflow path is defined by the USB charging port, the second air hole, the gap and an air channel; a smog airflow channel is provided in the atomization module; a cavity of the cigarette holder is interconnected to the smog airflow channel by a first air hole; a smoke airflow channel is defined by the cavity, the smog airflow channel and the first air hole; the sensor airflow path is configured to be parallel to the smog airflow channel, and is interconnected to the smoke airflow channel by the second air hole; an interconnection point is located on an upper portion of the cigarette holder and a lower portion of the smog airflow channel; and a sensor is located within the sensor airflow path.

* * * * *